United States Patent [19]

Pienta

[11] Patent Number: 4,882,892

[45] Date of Patent: Nov. 28, 1989

[54] DUAL STATION WRAPPING MACHINE

[75] Inventor: David J. Pienta, Temperance, Mich.

[73] Assignee: Automatic Handling, Inc., Erie, Mich.

[21] Appl. No.: 342,108

[22] Filed: Apr. 24, 1989

[51] Int. Cl.[4] ..... B65B 11/04; B65B 41/16

[52] U.S. Cl. ..... 53/176; 53/214; 53/587

[58] Field of Search ..... 53/137, 176, 211, 214, 53/587

[56] References Cited

U.S. PATENT DOCUMENTS

| | | | |
|---|---|---|---|
| 1,764,081 | 6/1930 | Jones et al. | 53/137 |
| 2,043,830 | 6/1936 | Grant et al. . | |
| 2,716,315 | 8/1955 | Jacoby | 53/587 |
| 2,803,935 | 8/1957 | Gibson | 53/137 |
| 2,844,928 | 7/1958 | Clem | 53/176 |
| 2,893,190 | 7/1959 | Lancaster | 53/176 |
| 3,099,117 | 7/1963 | Christiansen | 53/176 |
| 3,678,646 | 7/1972 | Clark . | |
| 3,863,425 | 2/1975 | Edwards et al. | 53/211 |
| 4,450,668 | 5/1984 | Grossi . | |
| 4,485,612 | 12/1984 | Piesen et al. | 53/211 |
| 4,534,151 | 8/1985 | Schneck et al. | 53/137 X |
| 4,553,372 | 11/1985 | Back . | |
| 4,565,051 | 1/1986 | Back . | |
| 4,598,534 | 7/1986 | Rosenthal et al. . | |
| 4,736,567 | 4/1988 | Pienta . | |
| 4,744,198 | 5/1988 | Hood et al. | 53/137 X |

FOREIGN PATENT DOCUMENTS

| | | |
|---|---|---|
| 2653730 | 6/1978 | Fed. Rep. of Germany . |
| 3412740 | 10/1985 | Fed. Rep. of Germany . |

*Primary Examiner*—John Sipos
*Assistant Examiner*—Beth Bianca
*Attorney, Agent, or Firm*—Emch, Schaffer, Schaub & Porcello Co.

[57] ABSTRACT

A dual station wrapping machine for serially wrapping material layers on rolls is disclosed. A conveyor moves a roll to a wrap station where a transfer arm moves the roll to a support roller. An upper hold down roller completes a three point support for the roll. A first station includes a fixed material applicator and a movable material applicator. A second station includes a movable material applicator.

9 Claims, 9 Drawing Sheets

DUAL STATION WRAPPING MACHINE

BACKGROUND OF THE INVENTION

Wrapping machines are well known in the art and are used to wrap various items. The present wrapping machine is an improvement over the wrapping machine shown in my U.S. Pat. No. 4,736,567 granted Apr. 12, 1988.

The present dual station wrapping machine is specifically designed to wrap rolls, for example, paper rolls. Some types of paper rolls, for example, carbonless paper, are very sensitive to marking. That type of roll may be wrapped with a protective foam layer or protective foam end coverings. Often, the foam is then covered with an impervious plastic film outer layer.

Other types of rolls, including paper rolls which are not as sensitive to marking, may be wrapped with other material layers, for example, with Kraft paper.

While the wrapping machine disclosed in my U.S. Pat. No. 4,736,567 could be used to interleave adjacent wrapping layers, the present dual station wrapping machine does not interleave the layers but, rather, places successive wraps on the roll.

SUMMARY OF THE INVENTION

The present invention is an improved wrapping machine which normally applies multiple layers of wrapping material to a roll. The multiple layers of the wrapping material are applied in a serial manner with the application of one layer finished prior to the time that the second layer is applied over the first layer.

In some embodiments, the layer does not extend throughout the length of the roll. For example, two layers of wrap material may simultaneously be applied to the opposed ends of a single roll. Subsequently an additional serially wrapped layer may be applied over the initial end wraps.

More specifically, the present invention relates to a dual station wrapping machine for serially wrapping a roll having a longitudinal axis of rotation. A conveyor moves a roll to be wrapped into position in the machine. A transfer or kicker roll moves the roll from the conveyor to a predetermined location which is dependent upon the diameter of the roll to be wrapped. A support and drive roller cooperates with the transfer roller for supporting the roll and rotating the roll. An upper hold down assembly engages the roll at its approximate longitudinal centerline. A first station adjacent the roll includes a fixed material applicator and a movable material applicator. A second station includes a second movable material applicator. A hold down table receives a wrapping material from one of the stations. The hold down table is pivotable from a generally horizontal position to a position adjacent the roll. At each station a wrap material is serially applied to the roll.

DESCRIPTION OF THE PREFERRED EMBODIMENTS

Figure 1:
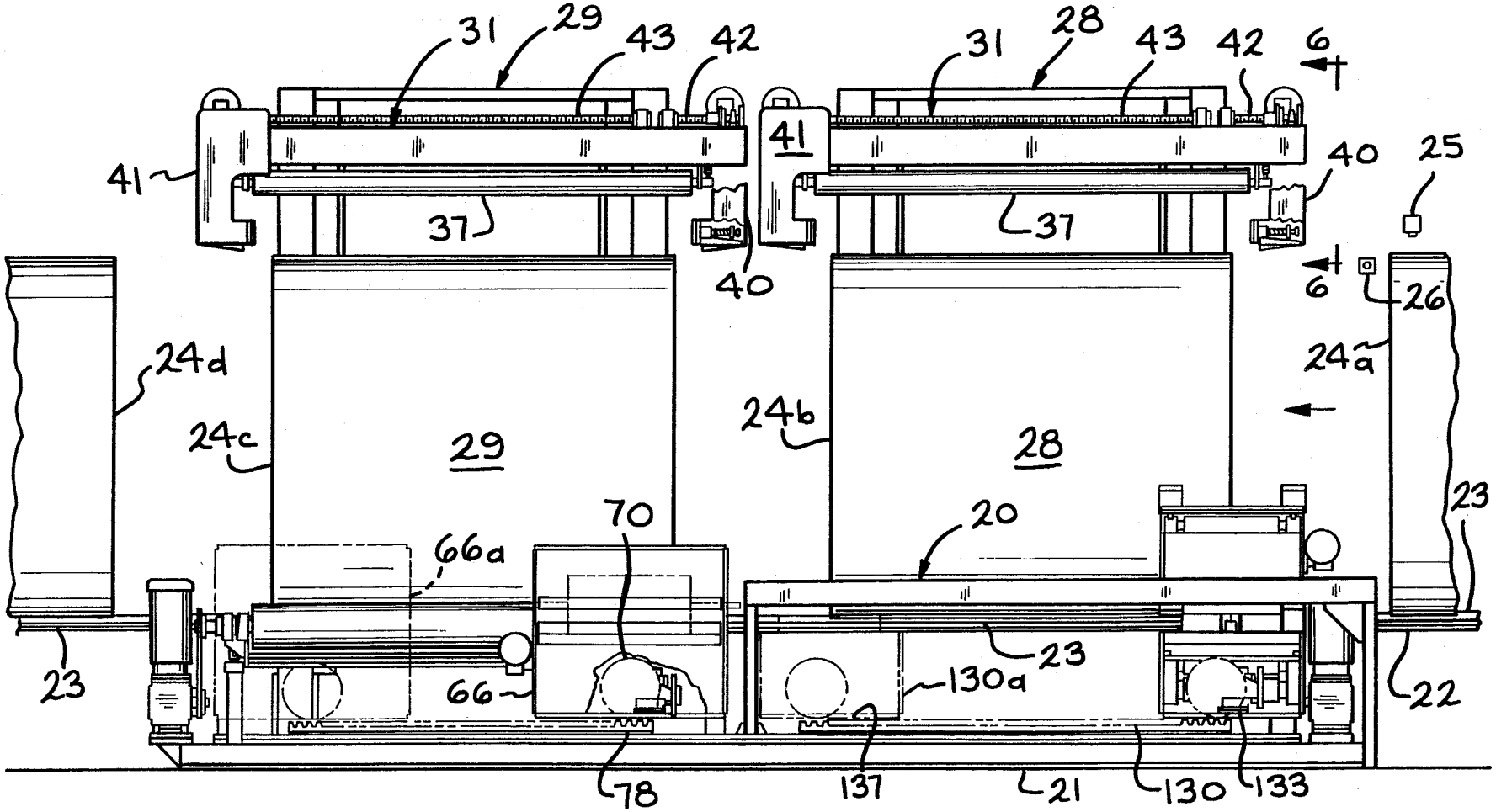
FIG. 1 is an elevational view of the dual station wrapping machine, according to the present invention, showing rolls being moved through the machine.
Figure 2:
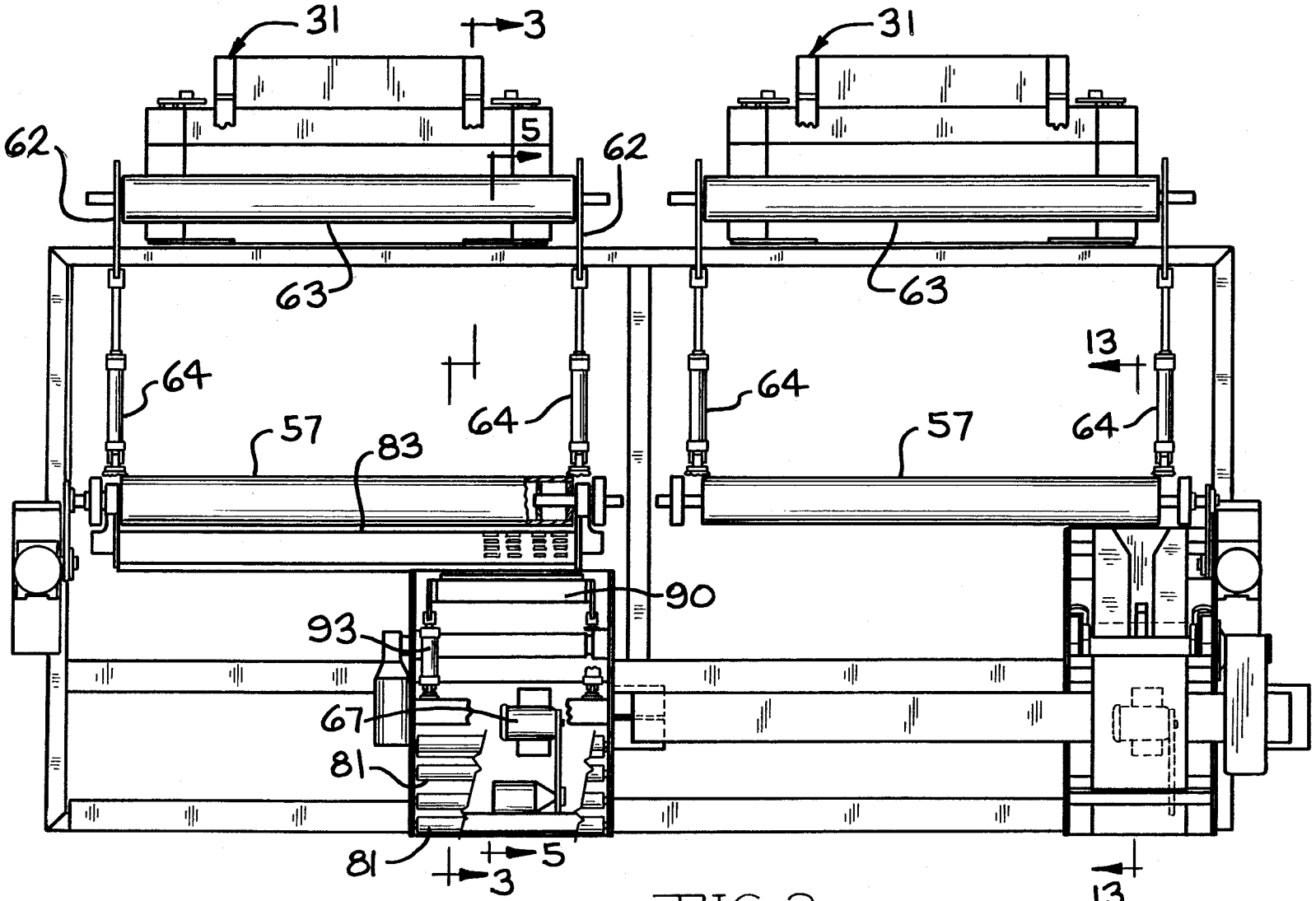
FIG. 2 is a plan view of the dual station wrapping machine shown in FIG. 1 with a portion of the hold down means deleted for clarity.

A dual station wrapping machine according to the present invention is generally indicated by the reference number 20. Referring to FIG. 1, the dual station wrapping machine 20 includes a frame 21. A chain conveyor 22 is mounted over the frame 21 and includes a plurality of trays 23 which carry paper rolls 24 into the machine 20 and receive the rolls 24 when they are discharged from the machine, as indicated by the roll 24d.

As the paper roll 24*a* enters the machine 20, a sensory unit 25 senses the diameter of the paper roll 24*a*. A sensory unit 26 senses the length of the paper roll 24*a*. The dual wrapping machine 20 includes a first station 28 and a second station 29. In the present embodiment, a foam material is applied at the first station 28 and a plastic film wrap material is applied at the station 29. However, it is understood that other types of wraps may be utilized at either of these stations without departing from the scope of the present invention.

Figure 3:
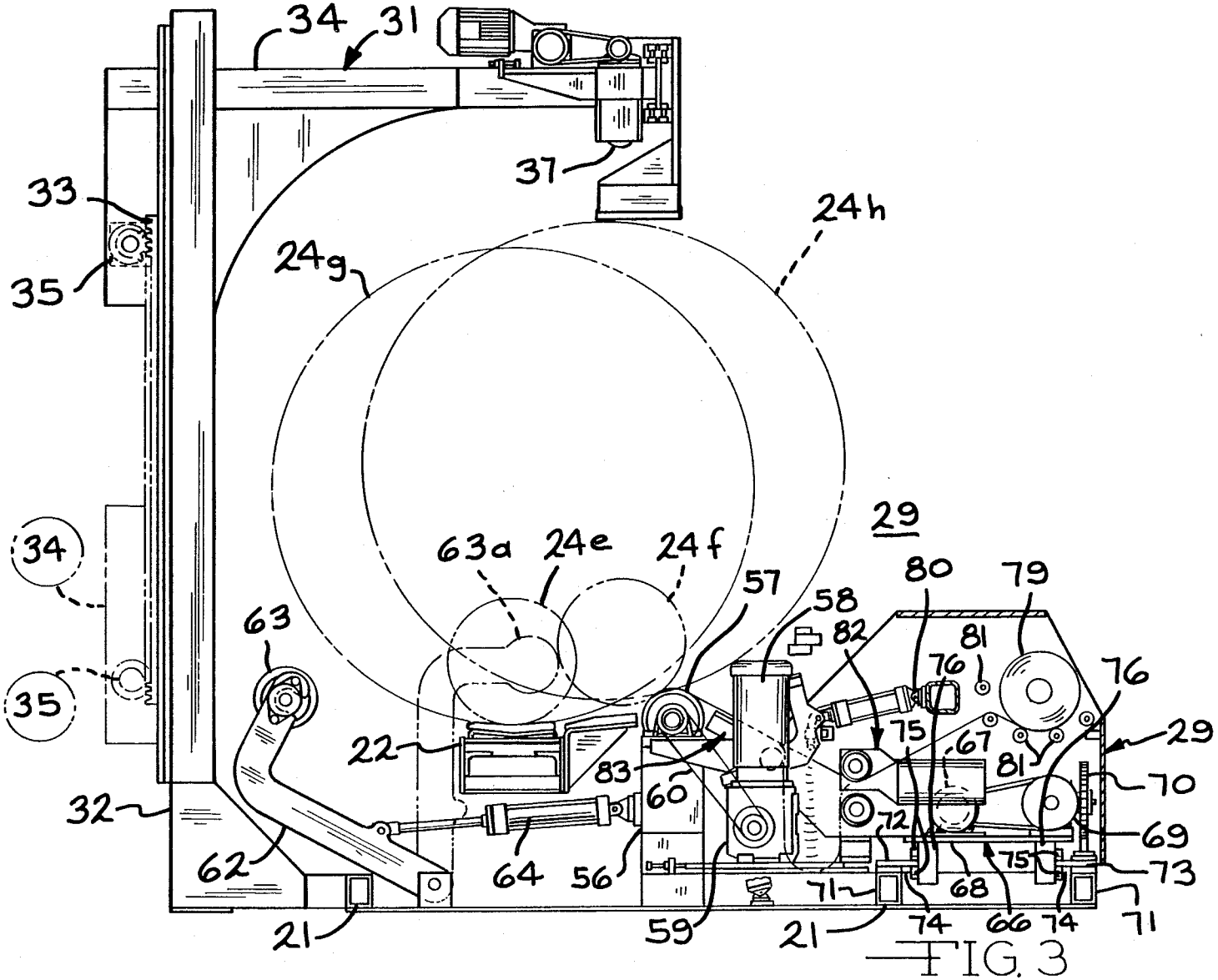
FIG. 3 is a sectional view taken generally along the line 3—3 of FIG. 2 and showing by dashed lines positions of small and large rolls to be wrapped both in the conveyor position and also after they have been moved to the wrapping position.

At each station, a hold down assembly 31 is positioned above the paper rolls 24. Referring to FIGS. 1 and 3, the hold down assembly 31 includes a vertical frame assembly 32 which extends upwardly from the machine frame 21. The vertical frame assembly 32 mounts parallel racks 33. A vertically movable top frame assembly 34 includes gears 35 which cooperate with the racks 33. Cylinders (not shown) are operatively connected to the movable vertical frame assembly 32 to vertically position the top frame assembly 34.

Figure 6:
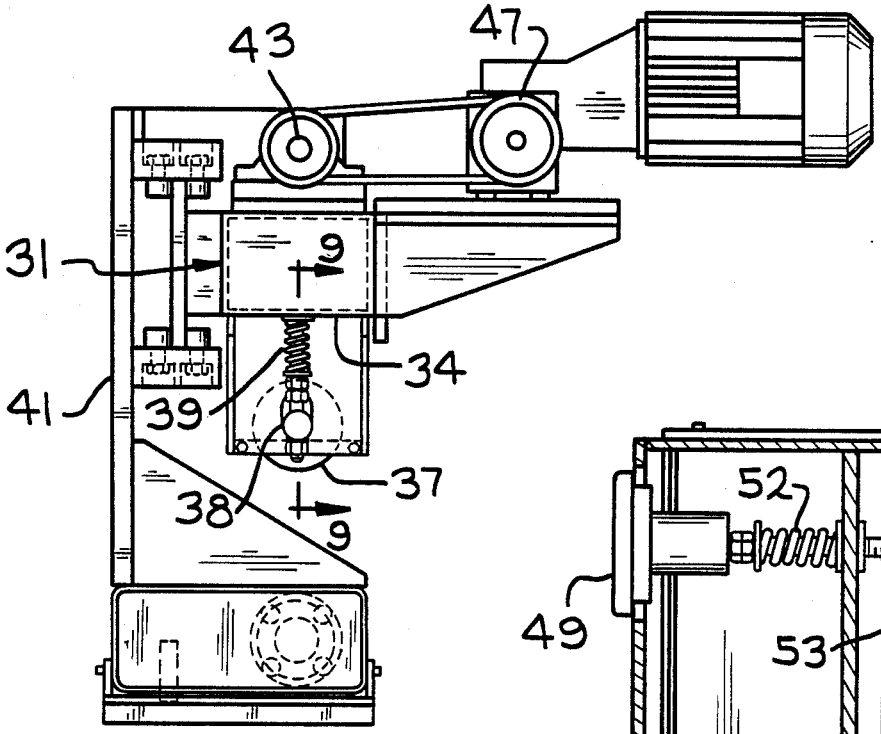
FIG. 6 is an enlarged view of a portion of the hold down assembly taken from approximately the line 6—6 of FIG. 1.
Figure 7:
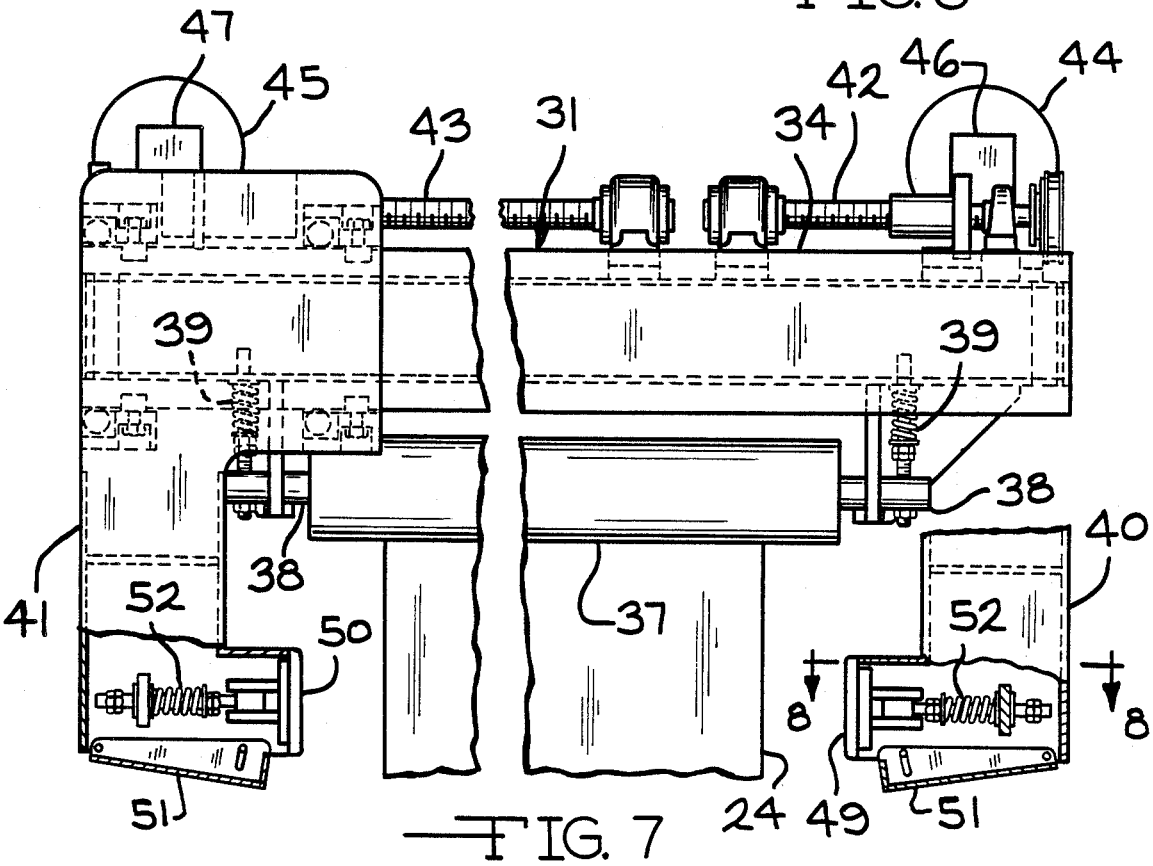
FIG. 7 is a top view of the hold down assembly shown on an enlarged scale.
Figure 9:
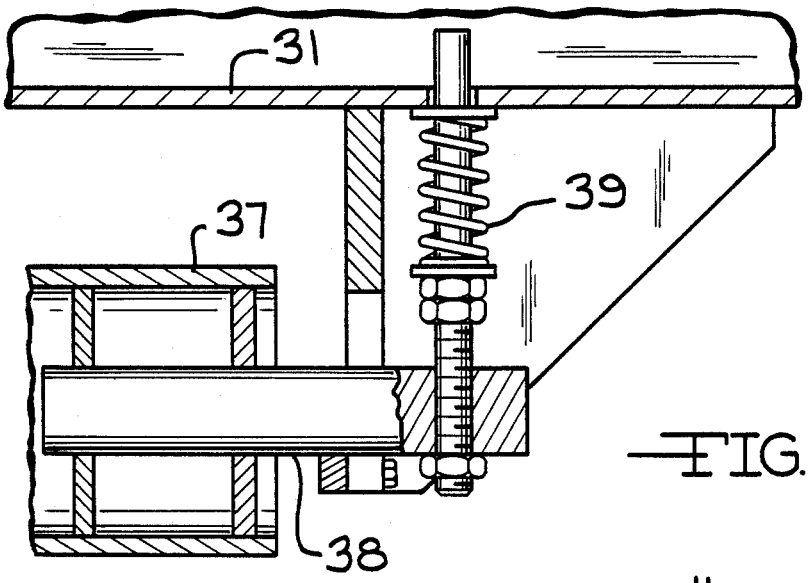
FIG. 9 is an enlarged cross-sectional view taken along the line 9—9 of FIG. 6.

Referring to FIGS. 6 and 7, the top frame assembly 34 mounts a top roller 37 which engages the paper rolls 24 at their approximate longitudinal centerlines. Stub shafts 38 extend outwardly from the ends of the top roller 37 and are mounted by spring assemblies 39 to the top frame assembly 34. As the top roller 37 is moved vertically into engagement with one of the paper rolls 24, if such paper roll is misaligned, one end of the top roller 37 is released by the spring assembly 39. This has a dual function, first, if the paper is sentitive it prevents damaging the roll 24. Secondly, it prevents damage to the machine 20.

End units 40 and 41 are movably mounted along the top frame assembly 34. The end units 40 and 41 are mounted on driven shafts 42 and 43 which are operatively connected to drive motors 44 and 45. The drive motors 44 and 45 are connected through reducer units 46 and 47 which in turn are connected to the driven shafts 42 and 43. Referring to FIG. 7, the driven shaft 43 is much longer than the driven shaft 42. In a normal operation, if a shorter length roll 24 is positioned within the machine 20, the sensory unit 26 senses the length of the roll 24 and sends a signal to the drive motors 44 and 45. A pad assembly 49 is located on the end unit 40 and a pad assembly 50 is located on the end unit 41. After the hold down top roller 37 is moved vertically downwardly, the end units 40 and 41 together with their pad assemblies 49 and 50 are moved inwardly adjacent the ends of the paper roll 24.

Switch plates 51 are pivotally mounted on the pad assemblies 49 and 50. If, during downward movement, the switch plates 51 engage the roll 24 a switch is energized and the machine movement deactivated. Again, this is a safety feature to prevent damage both to the rolls 24 and the machine 20.

Figure 8:
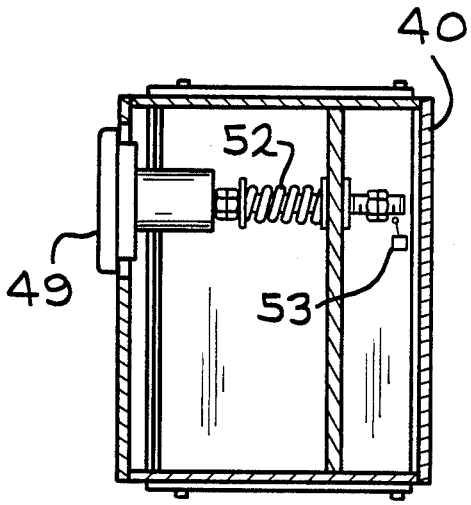
FIG. 8 is an enlarged cross-sectional view taken along the line 8—8 of FIG. 7.

Referring to FIG. 8, as the pad assemblies 49 and 50 move inwardly and engage the roll 24, a spring biased arm 52 is moved until it activates a switch 53. At this time, the machine 20 has received a clearance to proceed and the pad assemblies 49 and 50 remain closely adjacent the ends of the paper roll 24.

Referring to FIG. 3 which is a vertical cross-sectional view through the second work station 29, a plurality of paper roll positions are shown by dash lines. These include small roll positions 24*e* and 24*f* and large roll positions 24*g* and 24*h*.

In the embodiment of the dual station wrapping machine 20, shown in the enclosed drawings, the small rolls 24*e–f* may be as small as 300 mm in diameter while the diameter of the larger roll 24*g–h* is as large as 1500 mm in diameter.

Referring to FIG. 3, a vertical support 56 extends upwardly from the frame 21 and mounts a driven support roller 57. The support roller 57 is driven by a motor 58 through a gear reducer unit 59 and a belt 60. A transfer arm 62 is pivotally mounted by the frame 21 and mounts a transfer or kicker roller 63 adjacent its upper end. A cylinder 64 is mounted between the vertical support 56 and the transfer arm 62 to move the transfer roller 63 between the solid line position shown in FIG. 3 and the dash line position 63*a*. When the sensory unit 25 senses the diameter of the rolls 24, the transfer arm 62 moves the roll 24 to a predetermined location, depending of the diameter of the rolls 24 so that the upper top roller 37 of the hold down assembly 31 engages the specific roll 24 at a location approximately parallel to the longitudinal centerline of such paper roll 24. Referring to FIG. 3, the transfer roller 63 engages the roll 24*e* and transfers it from its position on the conveyor 22 to the dash line position 24*f*. The top roller 37 is then moved downwardly. A three point support is given the roll 24*f* consisting of the transfer roller 63, the driven support roller 57 and the top roller 37.

Similarly, with respect to the large paper roll 24*g*, the preprogrammed transfer roller 63 moves the paper roll 24*g* to the predetermined position 24*h* where again the top roller 37 is moved downwardly along a line approximately parallel to the longitudinal centerline of the paper roll 24*h*. Again, the three point support consists of the driven support roller 57, the transfer roller 63 and the top roller 37. This supports the large diameter paper roll in its position 24*h*.

FIG. 3 shows a cross section through the second station 29. In the present embodiment, the second station is a plastic film wrapping station and includes a movable material applicator generally indicated by the reference 66. As shown in FIG. 1, the material applicator 66 is movable from the solid line position to a location at the other end as indicated by the paper roll 66*a*. A motor 67 is mounted on a platform 68 and drives a gear reducer 69 and a connected gear 70. The frame 21 includes a pair of channel members 71 which mount guide plates 72 and 73. The guide plates 72 and 73 are fixed and include inner guide portions 74 which serve as guide paths for a pair of guide pins 75 which extend outwardly from blocks 76 mounted on the bottom of the platform 68. A longitudinally extending rack 78 is mounted above the guide plate 73 and cooperates with the gear 70 (see FIGS. 1 and 3). As the gear 70 is rotated, the platform 68 moves along the path defined by the guide portion 74 of the guide plates 72 and 73 so that the movable material applicator 66 may move back and forth between the positions 66 and 66a as shown in FIG. 1.

Figure 5:
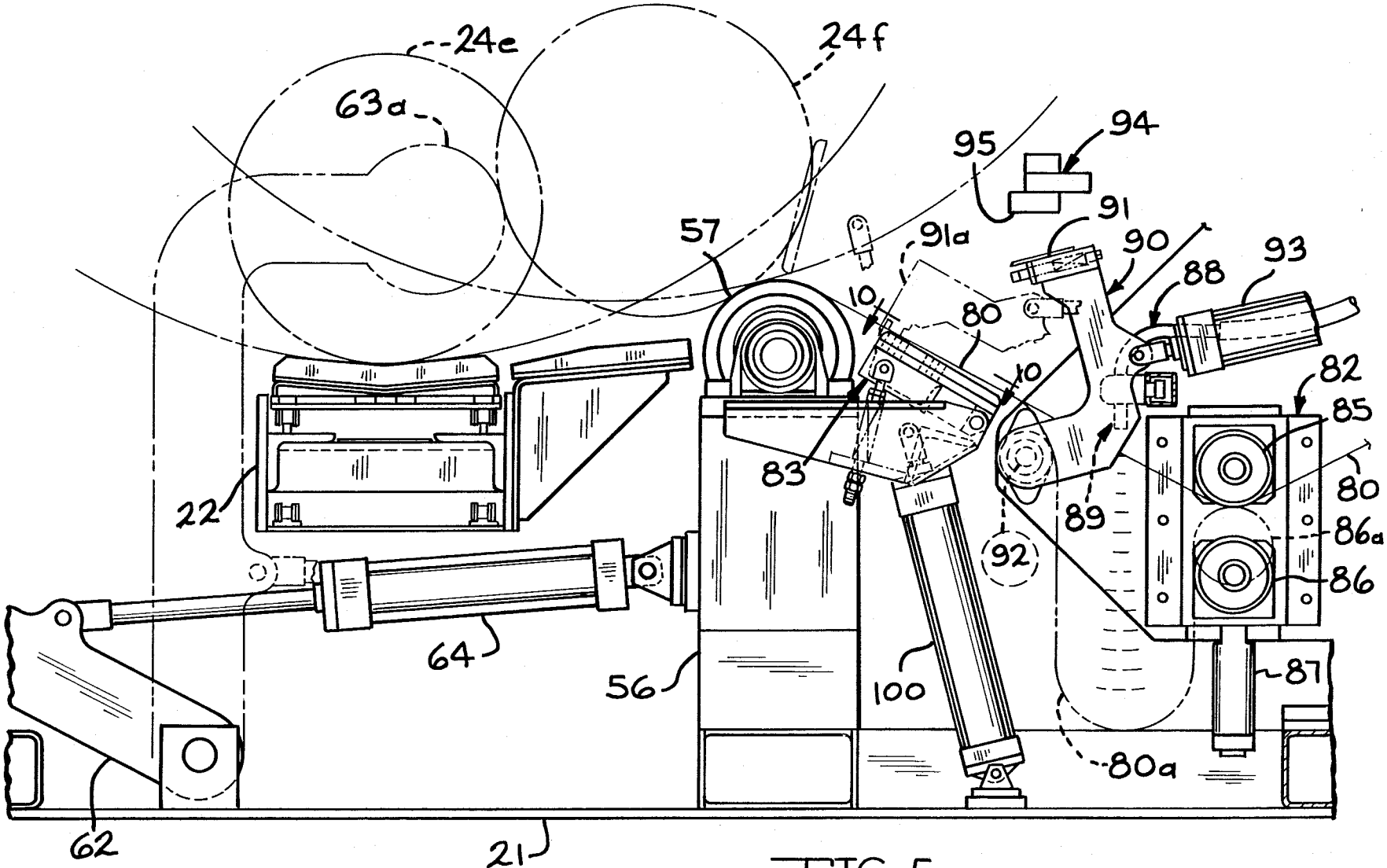
FIG. 5 is an enlarged sectional view taken along the line 5—5 of FIG. 2.

Referring to FIGS. 3 and 5, a supply roll of plastic film wrapping material 79 having a single plastic film layer 80 at its front end is supported by a plurality of arcuate positioned support rollers 81. A drive assembly, indicated by the reference number 82, pulls the plastic film layer 80 and delivers it to a table assembly, generally indicated by the reference number 83.

The drive assembly 82 includes an upper horizontal drive roller 85 and a lower horizontal pinch roller 86. A cylinder 87 is operatively connected to the lower pinch roller 86 and moves the pinch roller 86 from its down position, as indicated in FIG. 5, to an upper dash line position 86*a*. When in the upper position, the plastic film layer 80 passes between the nip formed between the rollers 85 and 86 and is fed toward the table assembly 83. Referring to FIG. 5, an air nozzle assembly 88 having a discharge nozzle 89 directs air downwardly on the plastic film layer 80 to place the film layer in a relaxed position as shown in the dash line position 80*a*. A cutting arm assembly 90 having a cutting head 91 is pivotably mounted on a shaft 92. A cylinder 93 is connected to the cutting arm assembly 90 and moves the cutting head 91 between the solid line position shown in FIG. 5 and the dashed line position 91*a*.

Figure 10:
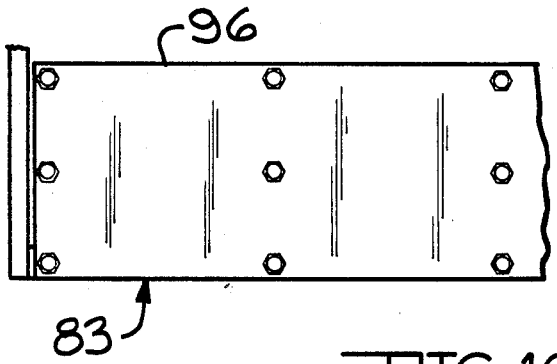
FIG. 10 is a plan view of the hold down table shown on an enlarged scale.
Figure 10:
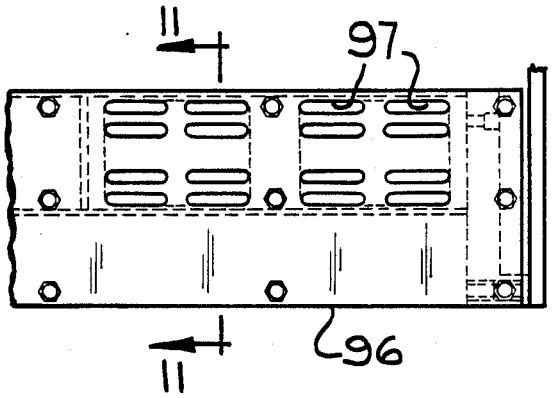
Figure 11:
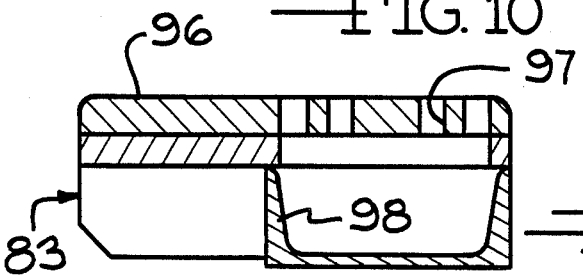
FIG. 11 is a cross-sectional view shown on an enlarged scale taken along the line 11—11 of FIG. 10.
Figure 14:
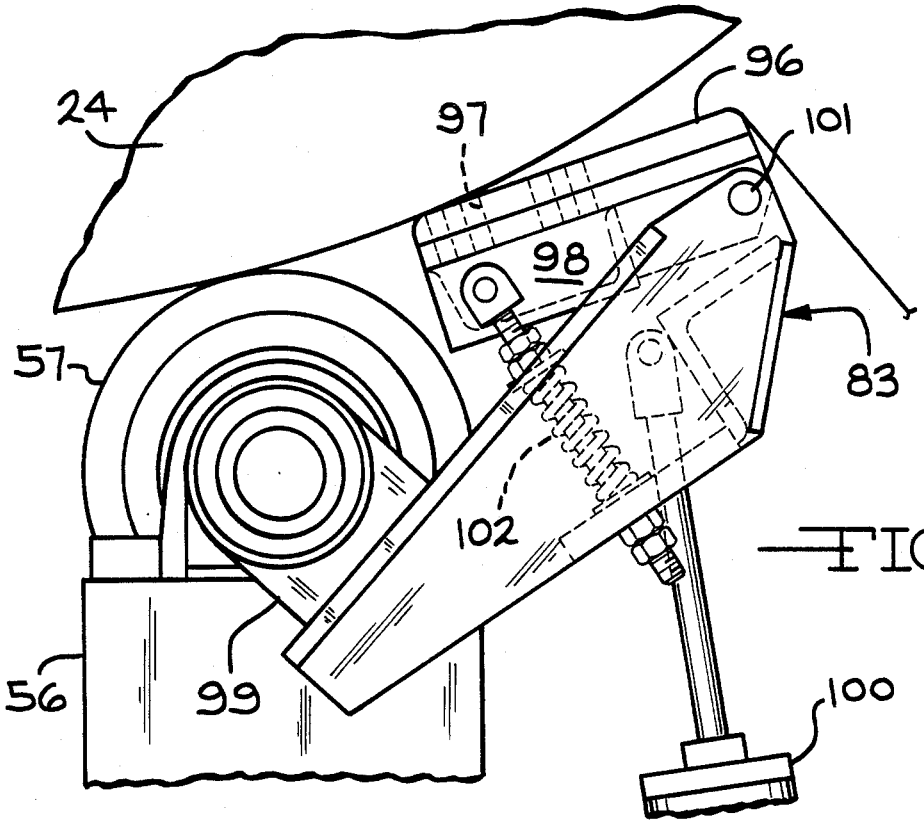
FIG. 14 is an enlarged view of the hold down table assembly including a hold down table engaging the roll.
Figure 15:
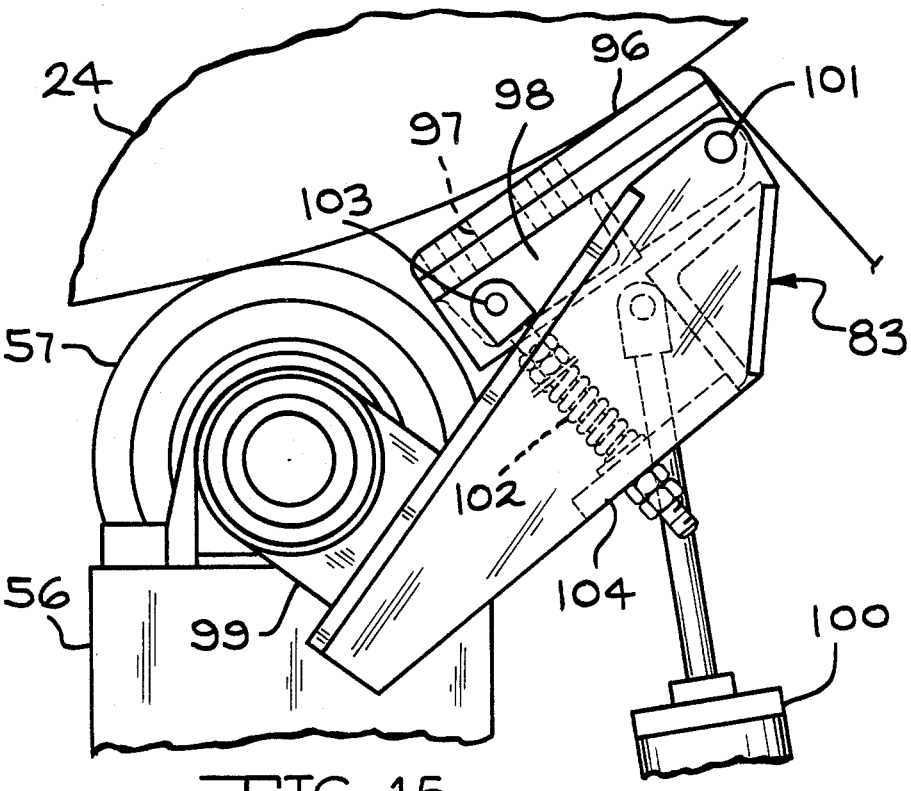
FIG. 15 is a view similar to FIG. 14 showing the hold down table as it is being rocked after it engages the roll.

A glue head assembly 94 having a nozzle 95 is positioned to apply a hot melt adhesive to the outer end of the plastic film layer 80 as it lies on the table assembly 83. Referring to FIGS. 10 and 11, the table assembly 83 includes a top plate 96 having a series of slots 97. The slots 97 are in communication with a vacuum chamber 98. The vacuum chamber 98 is maintained at a negative pressure, compared to atmosphere, to hold the plastic film layer 80 downwardly upon the plate 96 of the table assembly 83. Referring to FIGS. 14 and 15, the table assembly 83 is pivotally mounted by arms 99 at the upper ends of the vertical supports 56. Cylinders 100 pivot the table assembly 83 between the position shown in FIG. 5, where the layer 80 is initially received on the top plate 96 to the position shown in FIGS. 14 and 15 wherein the top plate 96 of the table assembly 83 is closely adjacent the periphery of the paper roll 24. In addition to the pivoting motion just described, the top plate 96 is pivotable around pivot pins 101. A spring assembly 102 has its upper end pivotally connected to a pin 103 and its lower end mounted to a base 104 in the lower portion of the table assembly 83. As shown in FIGS. 14 and 15, after the cylinders 100 have been extended and the top plate 96 placed adjacent the paper roll 24, the top plate 97 may be in an engaging relationship with the periphery of the paper roll 24. Continued relative motion compresses the spring assembly 102 and provides a rocking motion of the top plate 96. This ensures adherence of the leading edge of the plastic film layer 80 against the periphery of the paper roll 24. Subsequent to adherence, the cylinders 100 are retracted and the table assembly 83 moved back to its FIG. 5 position. The providing of the film loop 80*a*, as shown in FIG. 5, by the air nozzle 89, ensures that tensile forces are not created when the leading edge of the plastic film layer 80 is placed against the periphery of the paper roll 24 and the film layer 80 proceeds to wrap around the roll 24. This results in a steady and complete wrapping of the paper roll 24 without a tendency of having the film tension either tear the wrap away or lift the paper roll 24.

Figure 4:
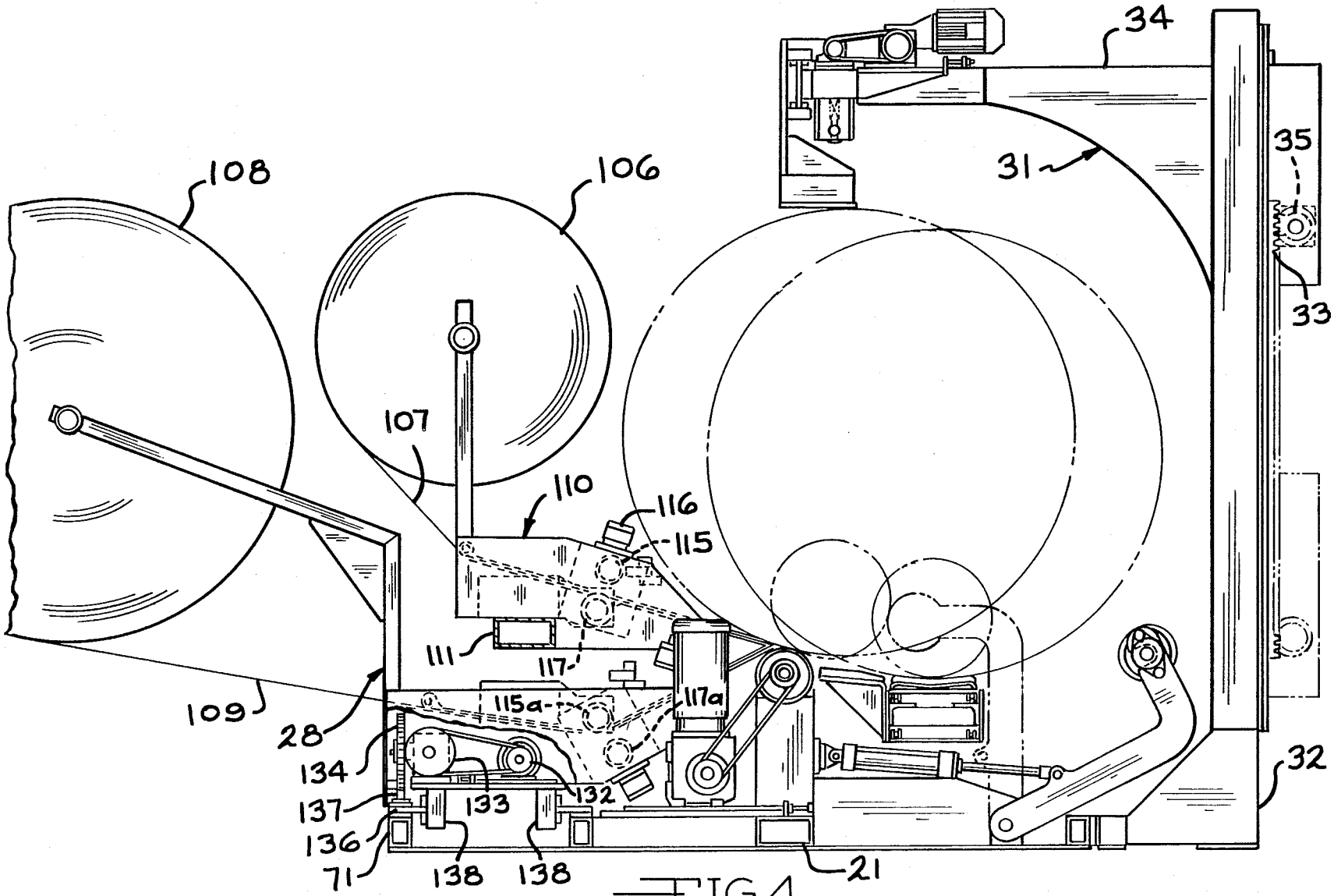
FIG. 4 is a view similar to FIG. 3, but looking from the opposite end of the dual station wrapping machine.
Figure 13:
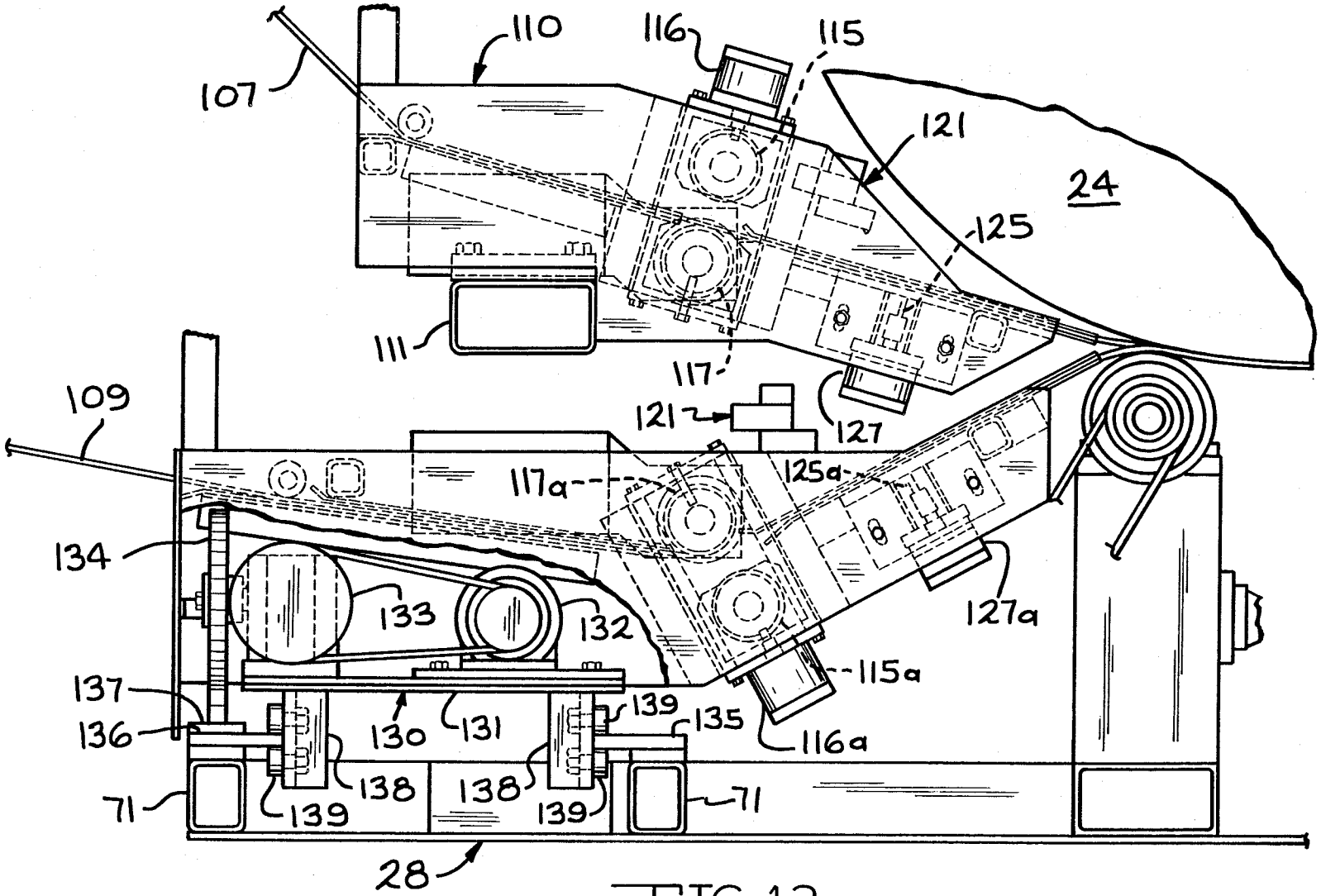
FIG. 13 is an enlarged cross-sectional view taken along the line 13—13 of FIG. 2 and showing the upper fixed material applicator and the lower movable material applicator.

Referring to FIGS. 4 and 13, the first station 28 of the dual station wrapping machine 20 is shown. In this embodiment, this station is to wrap initial foam layers on the paper rolls 24. The foam layer can either encapsulate only the end edges of the paper roll 24, or in the alternative, the entire outer periphery of the paper rolls 24.

Figure 12:
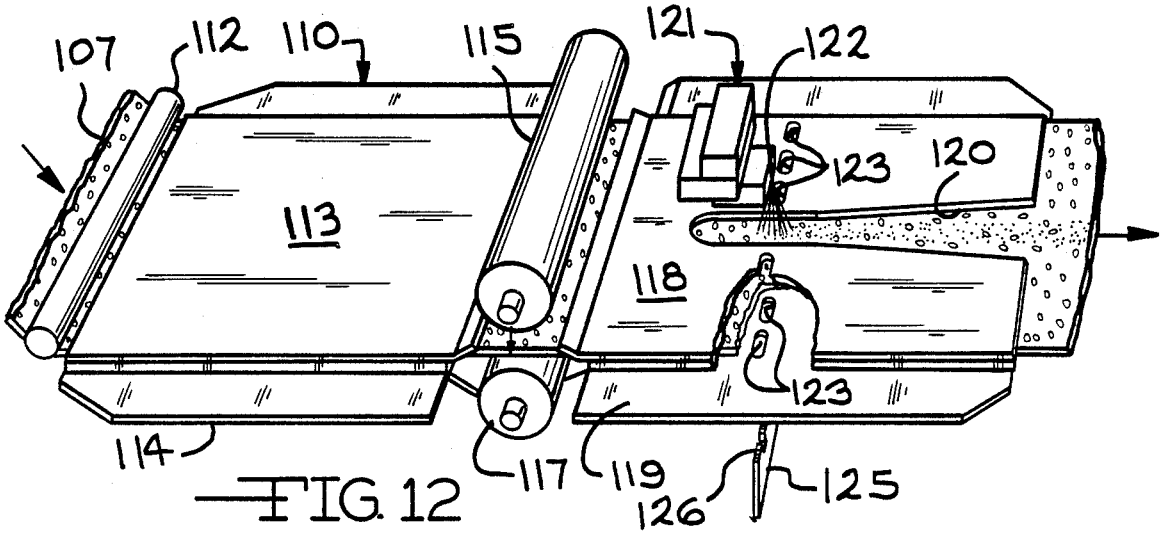
FIG. 12 is a perspective view of the foam wrap portion of the machine shown in FIG. 1.

Referring to FIG. 4, a foam supply roll 106 having a foam layer 107 is mounted above a foam supply roll 108 having a foam layer 109. The supply roll 106 and the foam layer 107 is fixed in position and supplies the foam layer 107 to a fixed head assembly 110 which is mounted on a beam 111 which in turn is connected to the main machine frame 21. Referring to FIG. 12, the upper foam layer 107 passes an idler roll 112 and between guide plates 113 and 114. A pinch roller 115 is vertically moved by a cylinder 116 (see FIG. 13) and cooperates with a lower driven roller 117 to urge the foam layer 107 between two additional plates 118 and 119. The plate 118 includes a slotted opening 120 along its longitudinal centerline. A glue head assembly 121 includes a nozzle 122 for applying a hot melt adhesive to the upper surface of the foam layer 107 through the opening 120 in the upper plate 118. The upper plate 118 and lower plate 119 define a plurality of slots 123 which are generally perpendicular to the longitudinal centerline of the plates 118 and 119. A serrated knife 125 includes cutting surfaces 126 which pass through the aligned slots 123 to cut the foam layer 107 when the foam layer application is completed. The serrated knife 125 is operatively connected to a cylinder 127 which moves the cutting surfaces 126 into and out of cutting position (see FIG. 13).

The first station 28 also includes a movable material applicator 130. A platform 131 mounts a motor 132 and gear reducing unit 133. The gear reducer unit 133 is operatively connected to a gear 134. Guide plates 135 and 136 are mounted by the channel member 71. A longitudinally extending rack 137 is mounted above the guide plate 136 and mates with the driven gear 134. Depending blocks 138 are supported by the platform 131. A series of guide pins 139 extend outwardly from the blocks 138. To move the material applicator 130, the motor 132 is energized and the gear 134 rotates and moves along the mating rack 137. The guide pins 139 are guided by the guide plates 135 and 136 to correctly align the material applicator 130. As best shown in FIG. 1, the material applicator 130 is movable from the solid line position 130 to the dashed line position indicated by the reference 130*a*.

The foam layer 139 is moved through a driven roller 117*a* and its mating pinch roller 115*a*. The pinch roller 115*a* is moved in and out of a drive position by a cylinder 116*a* (see FIG. 13). Similarly, a serrated knife assembly 125*a*, which is driven by a cylinder 127*a* is provided to cut the foam layer 109 at predetermined positions.

In a typical operation, in connection with the preferred embodiment of the wrapping machine 20 shown in the enclosed drawings, a paper roll 24*a* is moved along the conveyor 22 where it is initially sensed for length and diameter by the sensory units 25 and 26. The paper roll 24*a* is then moved to the position 24*b* in first work station 28. The paper roll 24 is then moved to the three point support position formed by the rolls 63, 57 and 37. In this particular embodiment, the material applicator 130 is moved to the position 130*a* and the foam wrapping material layers 107 and 109 are moved from the supply rolls 106 and 108, respectively. The foam layers 107 and 109 are moved by the rolls 115–117 and 115*a* and 117*a*. As shown in FIG. 12, hot melt adhesive is applied to the leading ends of the foam layers 107 and 109 and these layers are fed between the nip provided by the driven support roller 57 and the paper roll 24*b*. In this situation, the foam layers 107 and 109 cover only the ends of the paper roll 24*b*. The paper roll 24 is then moved to the position 24*c* and the material applicator 66 located at the second station 29 is activated. As earlier described, the plastic film material layer 80 is wrapped on the paper roll 24*c* in a serial wrap over the foam end layers 107 and 109. The movable material applicator 66 is then moved to the left, as shown in FIG. 1, until it reaches the position 66*a*. When in this position, the entire wrap has been completed. The paper roll 24*c* is then moved along the conveyor 23 to the unloaded position at 24*d*. It is understood that as the plastic wrap layer 80 is being applied at the position 24*c* a subsequent paper roll 24 has been positioned at the first station 28 and is being end wrapped with foam layers or completely wrapped with a single foam layer as desired.

Numerous modifications may be made to the preferred embodiments of the wrapping machine 20 shown and described herein and still fall within the scope of the following claims.

What I claim:

1. A dual station wrapping machine for serially wrapping a roll having a longitudinal axis of rotation and side edges, comprising, conveyor means for receiving a roll to be wrapped, such longitudinal axis of rotation lying in a generally horizontal plane, transfer means for moving such roll from the conveyor to predetermined positions, support and drive means for cooperating with said transfer means and for rotating such roll about its horizontally positioned axis, hold down means for engaging such roll at the approximate longitudinal centerline of such roll, a first station at a first of said predetermined positions including means fixedly mounted for feeding and wrapping a wrapping material layer around one end of such roll and means movable axially relative to such roll for feeding and wrapping a wrapping material layer around such roll and a second station at a second of said predetermined positions spaced from said first predetermined position including means movable axially relative to such roll for feeding and wrapping a material layer helically around such roll, table means for receiving a layer of wrapping material from one of said stations, said table means being pivotable from a generally horizontal position to a position adjacent the roll.

2. A dual station wrapping machine, according to claim 1, wherein said table means comprises a platform including spring means connected to said platform, whereby said platform may be rocked after it engages such roll.

3. A dual station wrapping machine, according to claim 1, including drive means adjacent said one of said stations for delivering wrapping material from a supply roll toward such roll and pressure release means between said drive means and said roll for reducing tension forces on such roll as it is being wrapped.

4. A dual station wrapping machine, according to claim 3, wherein said pressure release means include an air discharge nozzle means for discharging air against said wrap material.

5. A dual station wrapping machine, according to claim 1, wherein said hold down means includes roller means parallel with such longitudinal centerline of such roll, said roller means being vertically movable for engaging such roll and spring release means operatively connected to said roller means for releasing said roller means upon engagement with such roll if such roll is misaligned.

6. A dual station wrapping machine, according to claim 1, wherein said hold down means includes opposed side positioning assemblies for engaging the ends of such rolls and safety switches on said side positioning assemblies.

7. A dual station wrapping machine, according to claim 1, including adhesive means adjacent said hold down table for applying adhesive to a portion of such layer of wrapping material.

8. A dual station wrapping machine, according to claim 1, wherein said first station is a foam wrap station and said second station is a plastic film wrap station.

9. A dual station wrapping machine, according to claim 3, wherein said drive means for delivering wrapping material comprises first and second horizontal rollers, said first roller being a drive roller, said second roller being a pinch roller positioned below said drive roller, said pinch roller being vertically movable into engagement with said wrapping material and said drive roller.

* * * * *